US009920492B2

(12) United States Patent
Roetsch et al.

(10) Patent No.: US 9,920,492 B2
(45) Date of Patent: Mar. 20, 2018

(54) GROUND MILLING MACHINE HAVING A REPLACEABLE MILLING PART AND METHOD FOR REPLACING A MILLING PART OF A GROUND MILLING MACHINE

(71) Applicant: BOMAG GmbH, Boppard (DE)

(72) Inventors: Helmut Roetsch, Beltheim (DE); Maximilian Philippsen, Gingen an der Fils (DE); Steffen Wachsmann, Koblenz (DE); Frank Rheinbay, Boppard/Bad Salzig (DE)

(73) Assignee: BOMAG GmbH, Boppard (DE)

( * ) Notice: Subject to any disclaimer, the term of this patent is extended or adjusted under 35 U.S.C. 154(b) by 5 days.

(21) Appl. No.: 14/818,691

(22) Filed: Aug. 5, 2015

(65) Prior Publication Data

US 2016/0040371 A1 Feb. 11, 2016

(30) Foreign Application Priority Data

Aug. 8, 2014 (DE) ..... 10 2014 011 856

(51) Int. Cl.
*E01C 23/088* (2006.01)

(52) U.S. Cl.
CPC ..... *E01C 23/088* (2013.01)

(58) Field of Classification Search
CPC .. Y10T 403/60–403/602; E01C 23/088; E01C 23/127
See application file for complete search history.

(56) References Cited

U.S. PATENT DOCUMENTS 4,878,713 A * 11/1989 Zanetis ..... E01C 23/088 299/39.5
5,004,398 A * 4/1991 Wagner ..... E02F 3/28 172/273
5,098,252 A * 3/1992 Sheesley ..... E02F 3/3627 172/273
5,621,987 A * 4/1997 Pratt ..... E02F 3/3618 172/272
2008/0193210 A1* 8/2008 Beales ..... E02F 3/3618 403/326

(Continued)

FOREIGN PATENT DOCUMENTS

DE 102005060676 A1 6/2007
DE 102011018222 A1 10/2012
DE 102012012607 A1 1/2014

OTHER PUBLICATIONS

Espacenet, English Machine Translation of DE102005060676A1, published Jun. 21, 2007, retrieved from http://worldwide.espacenet.com on Aug. 3, 2015 (17 pages).

(Continued)

*Primary Examiner* — John J Kreck
(74) *Attorney, Agent, or Firm* — Wood Herron & Evans LLP

(57) ABSTRACT

The present invention relates to a ground milling machine, in particular, a road cold milling machine, having a replaceable milling drum unit. To make this replacement procedure easier, the present invention proposes a fastening device between the milling part and the machine part of the ground milling machine. The present invention furthermore relates to a method for replacing a milling part on the ground milling machine, a fastening device being used for this purpose.

21 Claims, 6 Drawing Sheets

(56) References Cited

U.S. PATENT DOCUMENTS

| | | | | |
|---|---|---|---|---|
| 2011/0286788 | A1* | 11/2011 | Sikorski | E02F 3/3618 403/315 |
| 2012/0284989 | A1* | 11/2012 | Busley | E01C 23/088 29/428 |
| 2013/0322959 | A1* | 12/2013 | Robl | F16D 1/00 403/326 |
| 2016/0040372 | A1* | 2/2016 | Eiden | E01C 23/088 29/426.1 |

OTHER PUBLICATIONS

Espacenet, English Machine Translation of DE102011018222A1, published Oct. 25, 2012, retrieved from http://worldwide.espacenet.com on Aug. 3, 2015 (13 pages).

Espacenet, English Machine Translation of DE102012012607A1, published Jan. 2, 2014, retrieved from http://worldwide.espacenet.com on Aug. 3, 2015 (17 pages).

* cited by examiner

GROUND MILLING MACHINE HAVING A REPLACEABLE MILLING PART AND METHOD FOR REPLACING A MILLING PART OF A GROUND MILLING MACHINE

CROSS-REFERENCE TO RELATED APPLICATION

The present application claims priority under 35 U.S.C. § 119 of German Patent Application No. 10 2014 011 856.8, filed Aug. 8, 2014, the disclosure of which is hereby incorporated herein by reference in its entirety.

FIELD OF THE INVENTION

The present invention relates to a ground milling machine, in particular, a road milling machine of the large milling machine type, having a replaceable milling part, as well as a method for replacing a milling part of a ground milling machine.

BACKGROUND OF THE INVENTION

Essential elements of a generic ground milling machine are a machine part having a machine frame, an operator platform, a drive engine, and transportation devices driven by the drive engine, for example, wheels and/or crawler tracks. The transportation units are connected via lifting columns to the machine frame, so that the distance of the machine frame to the ground is adjustable in the vertical direction. Furthermore, a generic ground milling machine comprises a milling part having a milling drum for milling ground material and a milling drum box for covering the milling drum to the sides and to the top. The milling part can be detachably fastened via a fastening unit, which holds the milling drum box on the ground milling machine. Such a ground milling machine is known, for example, from DE 10 2011 018 222 A1.

Generic ground milling machines are typically used in road and path construction. Ground milling machines of the type road cold milling machine are used in this case, for example, for milling off a road cover layer for road renovation. The width of the milling drum arranged on the ground milling machine is essential for the usage spectrum of such a ground milling machine, said milling drum typically being a hollow-cylindrical unit, on the outside jacket surface of which a plurality of milling tools is arranged in a known manner. The milling drum is typically supplied with drive energy by the drive unit of the ground milling machine, for example, via a mechanical or hydraulic drive train. In this case, the milling drum rotates inside a milling drum box about an axis of rotation extending horizontally and transversely to the working direction, and mills ground material while immersed in the ground. The milling drum box refers in this case to a housing-type aggregate, in the interior of which the milling drum is arranged protruding toward the ground. The milling drum box prevents milled material from being swirled around in an uncontrolled manner in working operation and additionally provides a compartment for more controlled milled material guiding. In other words, the milling roller box, which is open toward the ground, partially encloses the milling roller in the horizontal direction and to the top in the vertical direction.

Implementing the milling part as an aggregate, comprising the milling drum and the milling drum box, in a removable manner on the machine frame of the ground milling machine is known. Removal of the milling part can be desired, for example, if the ground milling machine is to be made lighter, in particular, for transportation purposes. It is apparent that the shortest possible working times are desired for the removal and the mounting of the milling part from/on the machine part. In addition, the need frequently exists of being able to mill various milling widths using the same ground milling machine. For this purpose, it is preferable if various milling parts can be attached to the same ground milling machine and rapidly exchanged with one another.

The possibility of removing the milling part as a whole from the machine part is described, for example, in DE 10 2011 018 222 A1. For this purpose, the milling drum box is detachably connected via solid fastening bolts and corresponding locking nuts to the machine part. It is disadvantageous in this case that the fastening bolts are frequently only accessible with great difficulty and accordingly other parts of the ground milling machine must first be removed to enable access to the fastening bolts. In addition, these are comparatively large bolts, so that correspondingly large forces must be applied for the mounting and removal. This is a challenge, in particular, in structurally cramped conditions. In addition, the overall time expenditure for the milling part replacement is also comparatively high in this alternative.

An object of the present invention is to specify a ground milling machine and a method for mounting/removing a milling part of a ground milling machine on or from a machine part, which, in comparison to the solutions known from the prior art, enable more rapid attachment and removal of the milling part to and from the machine part, which is simpler for the operator, in order, for example, to enable the milling part to be transported separately, so that a permissible maximum transport weight of the ground milling machine is no longer exceeded without milling part.

SUMMARY OF THE INVENTION

One aspect of the present invention is to provide a fastening device having at least one movable locking element and at least one counter element, via which the milling part is detachably fastenable as a module on the machine part. The fastening device is partially arranged on the machine part and partially arranged on the milling drum box in this case. The locking element and the counter element specifically designate two elements of the fastening device which interact with one another, and via which a fixation of the milling part on the machine part is finally enabled. For this purpose, the locking element is mounted according to one embodiment of the present invention so it is movable between a blocking position and a release position, depending on the embodiment either on the milling part or on the machine part. The counter element is arranged in each case on the other part, i.e., the machine part or the milling part.

The locking element is fundamentally implemented in such a manner that it blocks the counter element in a release direction to fasten the milling drum box on the ground milling machine in the blocking position. The release direction designates in this case a movement direction of the milling drum box or the milling part in relation to the machine part, in which the milling part must be moved away from the machine part in order to replace the milling part. At least in this direction, the locking element blocks the counter element when engaging the counter element in the blocking position. Without prior disengagement of the locking element from the counter element of the fastening device on the milling part and on the machine frame, the milling part therefore cannot be removed from the machine part. The fastening device and, in particular, the locking element and the counter element are therefore mounted on the milling part and on the machine part and are not formed as separate fastening means detached from these two elements.

The fastening device is therefore implemented in such a manner that the displacement of the locking element between its blocking position and its release position is performed in the state mounted on the ground milling machine, whether on the milling part or on the machine part. The individual parts of the fastening device are therefore present in a state partially connected to the machine part and the milling part even in the state of the milling part detached from the machine part. Therefore, the actuation of the locking element, or the displacement thereof, is performed in the state mounted on the machine part or milling part. A removal does not take place in the scope of the replacement procedure of the milling part.

Fundamentally, it may already be sufficient if the fastening device is implemented such that it only comprises one locking element and only one counter element. Typically and in consideration of the comparatively high forces to be absorbed, however, the fastening device preferably comprises multiple locking elements and accordingly also multiple counter elements. When one locking element and one counter element are mentioned hereafter, this therefore means in the scope of the present invention that this also comprises embodiments of the fastening device having multiple locking elements and multiple counter elements.

The counter element can fundamentally also be movable, in particular, between a release position and a blocking position. However, it is preferably implemented in a stationary manner on the respective support part, so that solely the locking element must be displaced in relation to the counter element for locking and unlocking. The overall construction and handling of the fastening device can thus be simplified. By way of a simple displacement of solely the locking element between the release position and the locking position, it is then possible to disengage the fastening of the milling part on the machine part or to reestablish it during mounting.

Preferably, the locking element is mounted on the machine part of the ground milling machine and the counter element is attached to the milling drum box. This embodiment of the present invention is preferable insofar as frequently further means, for example, actuating means and/or guide means, are required for the displacement of the locking element. Due to the arrangement of the locking element on the machine part, this component of the fastening device, which is typically more expensive and complex in practice than the counter element, therefore does not have to be replaced in each case on the machine part during a replacement of the milling part. In contrast, the counter element is formed substantially more simply in construction and with regard to structural expenditure, so that the arrangement of multiple counter elements identical to one another on various milling parts is more cost-effective and structurally simpler to achieve.

To make the mounting/removal operation of the milling part on the machine part easier, it is advantageous if the counter element is attached in a stationary manner to the respective support part, especially to the milling part and, in particular, to the milling drum box. Stationary is to be understood in this case to mean that the counter element is implemented fixed in place in relation to the milling drum box, for example. Furthermore, the counter element is ideally implemented such that it protrudes outward from the external surface of the milling drum box, for example, in particular, upward in the vertical direction in the case of attaching to the milling drum box and downward in the vertical direction in the case of attaching to the machine part, for example, in the manner of a hook, an eye, or the like. Such a counter element is particularly well suitable for engagement by the locking element and is comparatively simple to implement structurally. Alternatively, it is also preferable if the locking element is implemented as protruding, for example, in a hook-like manner, and engages in an internal counter element, especially on the milling drum box.

A further aspect of the present invention is that the fastening device is implemented as driven by a drive. For this purpose, the fastening device according to one embodiment of the present invention comprises a drive device, which drives a displacement of the locking element, preferably at least from the blocking position into the release position. The drive device is therefore implemented such that it drives a displacement movement of the locking element at least from the release position into the blocking position or vice versa, i.e., at least in one direction, although the present invention also comprises embodiments which have a drive of the displacement movement of the locking element by the drive device from the release position into the blocking position and vice versa. In other words, the drive energy required for the displacement movement is not applied manually but rather by the drive device. The fastening device is accordingly implemented as automatically actuatable according to one embodiment the present invention and can be operated by the operator, for example, by pressing a button or by shift lever movement. A hydraulic, pneumatic, electromechanical, or electrical drive device has specifically proven to be preferable for this purpose. In addition to suitable servomotors, which cause a corresponding displacement of the locking element, in particular, also cylinder-piston units can be used here. For the case in which the fastening device comprises multiple locking elements, provision may be made for a separate drive device to be provided for each locking element or a shared drive device to be provided for multiple and, in particular, all locking elements. For the first case, however, it is preferable if all drive devices are activated in such a manner that they are actuatable jointly and simultaneously by the operator.

A power supply is typically already present per se on the machine part of the ground milling machine, for example, for the transportation drive and for providing the drive power for the milling drum. The supply of the drive device of the fastening device therefore preferably also occurs from the machine part, for example, via an onboard electrical system or a hydraulic system on the machine part of the ground milling machine. For this reason, it is also advantageous if the drive device of the fastening device is mounted on the machine part and is supplied with drive energy from the ground milling machine to displace the locking element at least from the blocking position into the release position. Therefore, an independent energy source on the milling part or establishing required drive connections between the milling part and the machine part for the drive device of the fastening device can be omitted, whereby the overall implementation of the fastening device can be simplified.

To reduce the risk of injury and ensure reliable working use, the fastening device is preferably implemented as failsafe. This means that in the event of unpredicted failure of the fastening device, it is ensured that the fastening device does not disengage or the locking element does not assume the release position in an uncontrolled manner and the milling part does not fall off of the machine part in an uncontrolled manner. It may be provided for this purpose, for example, that in addition to the fastening device, a securing device, for example, in the form of a catch hook, etc., is provided, which secures the positioning of the milling part on the machine part separately from the fastening device. The locking element is preferably implemented as acting automatically at least toward the blocking position, however. This means that in the event of failure of the drive device, the locking element automatically assumes the blocking position, also from an existing release position. Such automatic displaceability is achieved particularly simply and cost-effectively in a mechanical manner, for example, in particular, using suitable spring loading of the locking element toward the blocking position, especially using a compression spring.

To enable reliable usage of the fastening device according to one embodiment of the present invention, a sensor device is preferably provided, which is designed to detect the blocking position and/or the release position of the locking element. The essential task of the sensor device is therefore to ensure that the locking element has reached its release position and/or it's blocking position during a displacement. To this end, the sensor unit can specifically comprise one or more pressure contact switches, for example, which are actuated by the locking element upon reaching the respective end position. Alternatively, of course, other suitable sensors can also be used here, for example, light barriers, etc. The sensor device, therefore, checks in the simplest case whether the locking element is in one of the two end positions or not. A refinement of this embodiment provides an implementation of the sensor device such that additionally or alternatively the engagement of the locking element on the counter element and/or its release is monitored. In this manner, not only is the position of the locking element detected, but rather simultaneously its current position in relation to the counter element, for example, to ensure simultaneously that the locking element is in the blocking position and blocks the counter element in this case. For this purpose, for example, corresponding pressure contact switches can be provided which, when the locking element is in the blocking position, are actuated by the counter element. It is particularly preferable if furthermore a display device is provided, which displays the state detected by the sensor device, for example, "milling part locked" or "milling part released". This can occur via simple display lights or, in particular, also via a suitable display screen indication.

With reference to the specific implementation of the fastening device, a broad spectrum of alternative embodiments can fundamentally be used. An implementation of the locking element of the fastening device has proven to be particularly suitable such that it has at least one clamping lever, which is pivotable, in particular, about a horizontal axis, having a blocking projection, which at least partially engages behind the counter element in the blocking position. The clamping lever therefore has a, for example, hooked blocking projection, which can act as a stop in relation to the counter element in the release direction. Complementary thereto, the counter element accordingly has a stop part, which the blocking projection of the clamping lever can engage behind in the release direction. By applying these two stops against one another, a movement of the milling part in the release direction away from the machine part is accordingly blocked when the locking element is located in the blocking position.

Alternatively, to the clamping lever, the locking element of the fastening device can, for example, also be a locking slide, which is displaceable, in particular, in the horizontal direction. A linear displacement movement between the blocking position and the release position distinguishes the locking slide. In this embodiment, the counter element then accordingly comprises a locking slide receptacle, in which the locking slide at least partially engages in the blocking position. Such a locking slide receptacle can be, for example, the enclosure region of a hook, a blocking projection, or a comparable element. The advantage of this embodiment is that the vertical space requirement of the fastening device is comparatively small at least on the side of the locking slide.

The part of the fastening device on which the locking element is mounted is preferably implemented such that the locking element does not protrude freely toward the external environment. This means that the locking element is arranged, preferably on the machine part, such that it is covered toward the milling drum box by a cover, a receptacle opening being provided in the cover, through which the counter element, which protrudes upward from the milling drum box in the vertical direction, is insertable. The locking element is protected to the outside from external influences by the cover.

To achieve a particularly durable and reliable fastening of the milling part on the machine part, the fastening device is preferably implemented in such a manner that it has a clamping device, which is implemented in such a manner that, when the locking element is in the blocking position, it tightens the milling drum box via the counter element in the vertical direction toward the ground milling machine or clamps the milling part and the machine part to one another with a tightening force. The clamping device is therefore specifically provided for the purpose of enabling a tightening force and/or a tightening torque, using which the milling part is clamped or tightened in relation to the machine part. The clamping device can also be part of the fastening device or can be implemented as spatially and functionally separated therefrom. Specifically, the clamping unit can have a sliding bevel extending diagonally to the horizontal plane for this purpose, for example, which acts against the counter element or vice versa when the locking element is located in the blocking position. Alternatively, or additionally, it is also possible to provide the clamping device with separate clamping elements, for example, tightening springs or comparable elements, which act separately from the interaction between the locking element and the counter element. The sliding bevel preferably comprises in this case a sliding surface which extends at an angle of less than 30° to the horizontal plane. A type of fixing wedge is obtained by the sliding bevel, on which the respective counter element or locking element runs and, in particular, is also fixed via a friction lock.

To provide the clamping force required for fixing the clamping device, the clamping device may preferably comprise at least one clamping cylinder, which is arranged in such a manner that, in the pressure-loaded state, it presses the milling drum box against the machine part or tightens it against the machine part. In this context, in particular, the use of a clamping cylinder which is implemented as a hollow cylinder having a central recess has proven to be particularly suitable, the central recess preferably being provided for threading in or accommodating the counter element and therefore, with respect to the milling part and the machine part, being arranged on the side of the part of the fastening device carrying the locking element. The counter element is therefore guided through the central recess of the hollow cylinder or at least engages therein during the fastening of the milling part on the machine part in this embodiment. Opposite to the intake side of the central recess, the access of the locking element of the fastening device to the counter element is preferably performed, in particular, in a region protruding beyond the hollow cylinder. This overall arrangement, which is implemented comparably to a tool clamping device, is particularly preferable because of its particularly small installation space requirement, in particular.

The clamping cylinder is ideally arranged in this case in such a manner that it preferably presses in the vertical direction from below against a locking slide, in particular, the locking slide of the fastening device. The clamping cylinder preferably specifically acts perpendicularly to the displacement direction of the locking slide, so that with regard to the movement sequence, the clamping procedure is performed perpendicularly to the displacement movement of the locking slide.

To monitor the adjustment procedure of the clamping cylinder, it has proven to be advantageous if a monitoring device is provided, which is implemented such that it monitors the clamping path of the clamping cylinder. In this manner, a detection of the actuating position of the locking element is performed indirectly via the current position of the clamping cylinder. Specifically, any type of distance sensors can fundamentally be used for this purpose, which enables corresponding ascertainment and monitoring of the clamping path or displacement path of the clamping cylinder. For example, a magnetostrictive position sensor which is integrated in the interior of the piston-cylinder unit of the clamping cylinder is particularly suitable for this purpose, as is disclosed, inter alia, in DE 10 2005 060 676 A1, which is hereby incorporated by reference. The monitoring device can therefore, in particular, also be part of the above-mentioned sensor device.

For reliable positioning of the milling part on the machine part, it is preferable for a form-fitting device to be provided for positioning the milling drum box on the machine part, in particular, a form-fitting device acting in the horizontal direction. Acting in the horizontal direction is to be understood in this case to mean that the form-fitting device causes a form fit between the milling part and the machine part in such a manner that at least one direction is blocked by the form fit in the horizontal direction. Ideally, the form-fitting device is implemented in such a manner that the form fit enables an alignment in all horizontal directions, i.e., the form fit is established in a horizontal plane. The form-fitting device enables the operator to achieve and maintain an exact alignment of the milling part in relation to the machine part. A variety of alternative embodiments can also be used with regard to the specific implementation of the form-fitting device. For example, the form-fitting device can comprise a pin protruding in the vertical direction, in particular, on the milling drum box, and a pin receptacle, in particular, on the machine part, wherein the pin is insertable in a form-fitting manner into the pin receptacle. The pin receptacle can be, for example, a passage opening or an opening like a pocket hole, which is adapted with respect to its cross-sectional area to the cross section of the pin. When the pin engages in the pin receptacle, a form fit is obtained perpendicularly to the insertion direction, in particular, toward the inner wall of the pin receptacle. The pin receptacle and the pin are therefore preferably implemented as complementary to one another with respect to their cross section. In this case, the pin and the pin receptacle can have, for example, a round, elliptical, polygonal, or differently implemented external contour. The form-fitting device can alternatively thereto, for example, also be a ribbing or comparable complementary structuring implemented between the milling part and the machine part, which counteracts a horizontal displacement of the milling part in relation to the machine part.

It may be preferable in this context if the form-fitting device is implemented separately from the fastening device and therefore structurally and functionally separated therefrom. The form fit securing for the horizontal alignment of the milling part in relation to the machine part is therefore performed spatially and functionally separated from the fastening device in this exemplary embodiment.

Alternatively, thereto, the form-fitting device can also be part of the fastening device. In this embodiment, the fastening device and the form-fitting device therefore form a functional unit in this refinement of the present invention. This embodiment has the advantage that the form-fitting device and the fastening device are implemented extremely compactly in their entirety.

It has been shown that, in particular, the precise alignment of the milling part in relation to the machine part is a challenge for the operator in practical use, in particular, to achieve reliable and correct alignment of the milling part in relation to the machine part. To make this procedure easier, the ground milling machine preferably has a centering device, which is especially implemented for the fine alignment of the machine part in relation to the milling part, to ensure reliable positioning of the locking element in relation to the counter element of the fastening device. Fine alignment refers in this case to positioning in the range of a few centimeters. The essential task of the centering device is therefore that it enables, starting from imprecise pre-positioning of the milling part in relation to the machine part, guiding toward precise alignment for the effective fastening by the fastening device. Such a centering device can be in the form of, for example, at least one or more conical projections protruding in the vertical direction and corresponding conical receptacles arranged in the other part of the ground milling machine. In particular, in this case conical projections can be provided on the milling part and corresponding conical receptacles can be provided in the machine part at suitable points. It is optimal in this case if the conical projection is seated on a pin of the form-fitting device, as has already been described above. The conical projection seated on the pin enables an ideal alignment of the milling part in relation to the machine part toward the desired form fit between the milling part and the machine part due to the form-fitting device.

The advantage of a centering device which works with conical elements is that the centering is performed in all directions of the horizontal plane if the cone axis extends in the vertical direction. However, other spatial structures can also be used for the centering in this context. It is possible, for example, that the centering device has tooth structures on the machine part and on the milling drum box, which tooth structures are implemented as complementary to one another, having inclined tooth flanks which are implemented for form-fitting interlocking. These tooth structures can have inclined tooth flanks which extend linearly or in a curve. The advantage of such tooth structures is that they can be machined relatively coarsely and at the same time enables sufficient centering for the present purpose.

A further aspect of the present invention is finally also a method for mounting and removing a milling part on or from a ground milling machine, in particular, a ground milling machine as described above. Concerning the structure of such a ground milling machine, the elements thereof, and their interaction with one another, reference is also made to the above description with regard to the method according to the present invention.

The method according to one embodiment of the present invention for mounting and removing a milling part on or from a machine part comprises, as the first step for the removal, firstly a displacement of a locking element of a fastening device, via which the first milling part is held on the machine part of the ground milling machine, from the blocking position into a release position. The fastening connection by the fastening device between the first milling part and the machine part is thereby disengaged. For this purpose, the milling part can be set down on the ground or a transport vehicle beforehand, for example, by a vertical displacement of lifting columns of the ground milling machine. When the milling part is removed, the ground milling machine or the machine part is substantially lighter, which is advantageous, in particular, with regard to maximum transportation weights of such machines. A milling part can also be reattached to the machine part, for example, after a transport or to obtain a different milling width, wherein the first milling part is replaced by a second milling part. The milling part to be mounted is firstly positioned in relation to the machine part of the ground milling machine for this purpose such that at least one counter element and the at least one locking element of the fastening device are aligned in relation to one another such that the locking element is displaceable back into the blocking position to block the counter element. The two elements of the fastening device which are responsible for the fastening, the locking element and the counter element, are thus brought into the positions required for the blocking position. Finally, the displacement of the locking element from the release position into the blocking position is performed to fasten the milling part on the machine part of the ground milling machine.

It is provided in the method according to the present invention that, for the mounting/removal of the milling part, the actuation of the locking element between the blocking position and the release position is required. This displacement of the locking element is driven by the drive device. Especially hydraulically, mechanically, electromechanically, or pneumatically operating drive devices can be used in this case, which respectively act on the locking element. In this refinement, the method according to one embodiment of the present invention therefore also comprises an actuation of the drive device by the operator, for example, to achieve the desired displacement of the locking element.

The method according to one embodiment of the present invention is furthermore made easier if, during the positioning of the milling part, an alignment of the milling part in relation to the machine part is performed in the horizontal plane via a centering device. Additionally, or alternatively thereto, it is furthermore preferable if position securing of the milling part in relation to the machine part is ensured by a form-fitting device, as was described above.

BRIEF DESCRIPTION OF THE DRAWINGS

The present invention will be explained in greater detail hereafter with reference to the exemplary embodiments indicated in the figures. In the schematic figures.

Like components are designated by like reference numerals in the figures, wherein not every component is necessarily repeatedly designated in every figure.

DETAILED DESCRIPTION OF THE INVENTION

Figure 1:
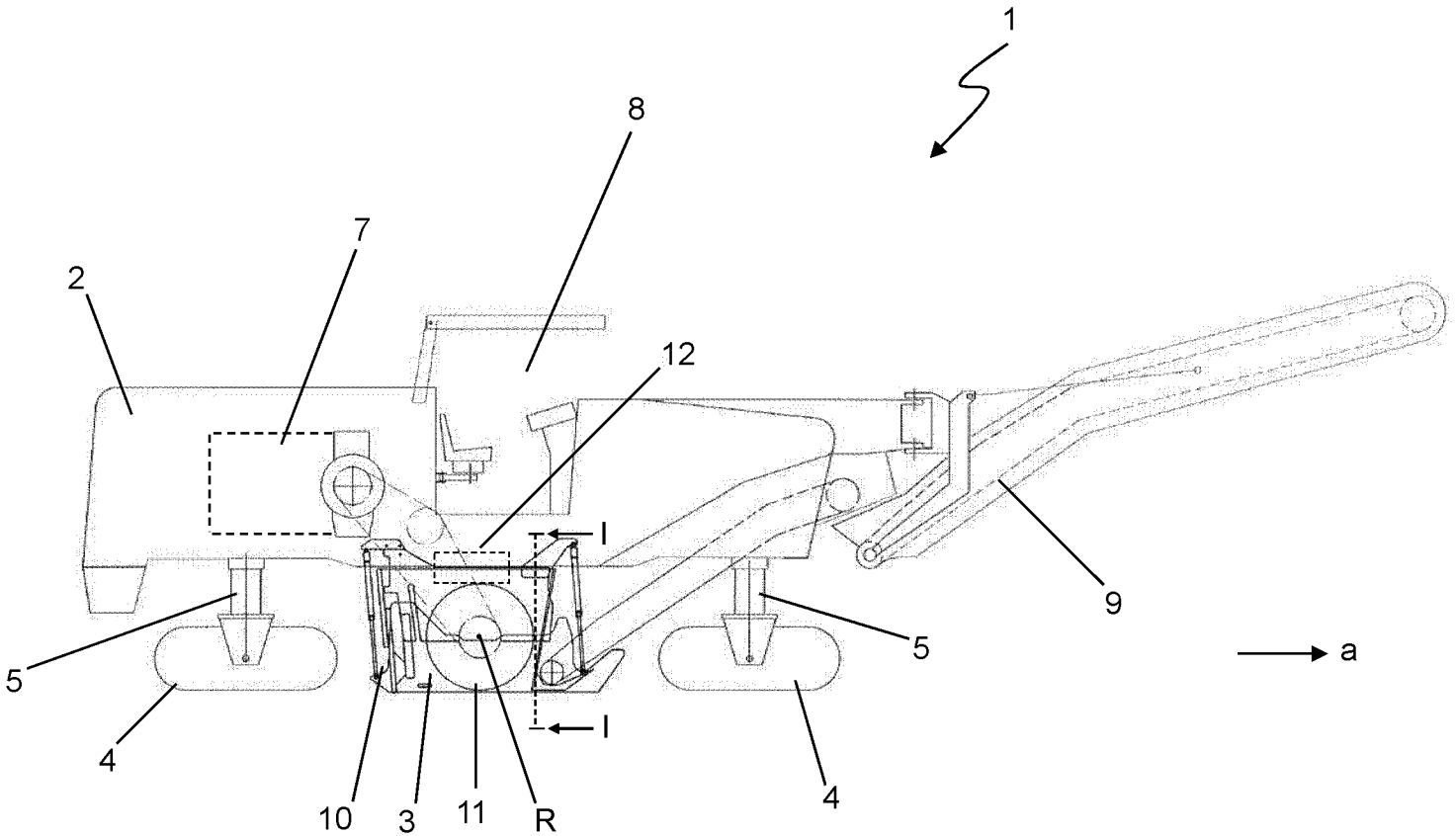
FIG. 1 shows a side view of a ground milling machine.

FIG. 1 shows a generic ground milling machine 1, in the present case a road cold milling machine. Specifically, it is a large milling machine of the center rotor type. The essential elements of the ground milling machine are a machine part 2 and a milling part 3. The machine part 2 comprises a machine frame 6, which is supported by transportation devices 4 via lifting columns 5, having a drive engine 7, an operator platform 8, and a milled material conveyor device 9. The lifting columns 5 enable a vertical displacement of the machine frame 6 in the vertical direction in relation to the ground. The drive engine 7 supplies the drive energy required for the travelling drive and the drive of the milling device explained in greater detail hereafter. The operation of the ground milling machine 1 is performed from the operator platform 8 by an operator. In working operation, the ground milling machine 1 travels over the ground to be processed in the working direction a and mills off milled material at the same time. This is specifically performed using the milling part 3, comprising a milling drum box 10 and the milling drum 11, which is arranged in the interior of the milling drum box 10. The milling drum box 10 comprises as a whole a front wall, a rear wall, a cover located above the milling drum 11, and covers on the sides to the right and to the left. The milling drum box 10 is implemented as open toward the ground, so that the milling drum 11 positioned inside the milling drum box 10 can engage in the ground from the milling drum box 10. For the milling operation, the milling drum 11 rotates about an axis of rotation R, which extends horizontally and transversely in relation to the working direction a.

The milling part 3 is implemented as removable as a modular unit in relation to the machine part 2 of the ground milling machine 1. For this purpose, a fastening device 12, which is only indicated very schematically in FIG. 1, is provided for attaching the milling part 3 on the machine part 2. The structure and the function of this fastening device 12 will be explained in greater detail in the following figures. It is apparent that, for the mounting/removal of the milling part 3, the drive train, which is partially implemented as a belt drive in the present exemplary embodiment, must be disconnected and reestablished after the installation of the milling part 3.

Figure 2:
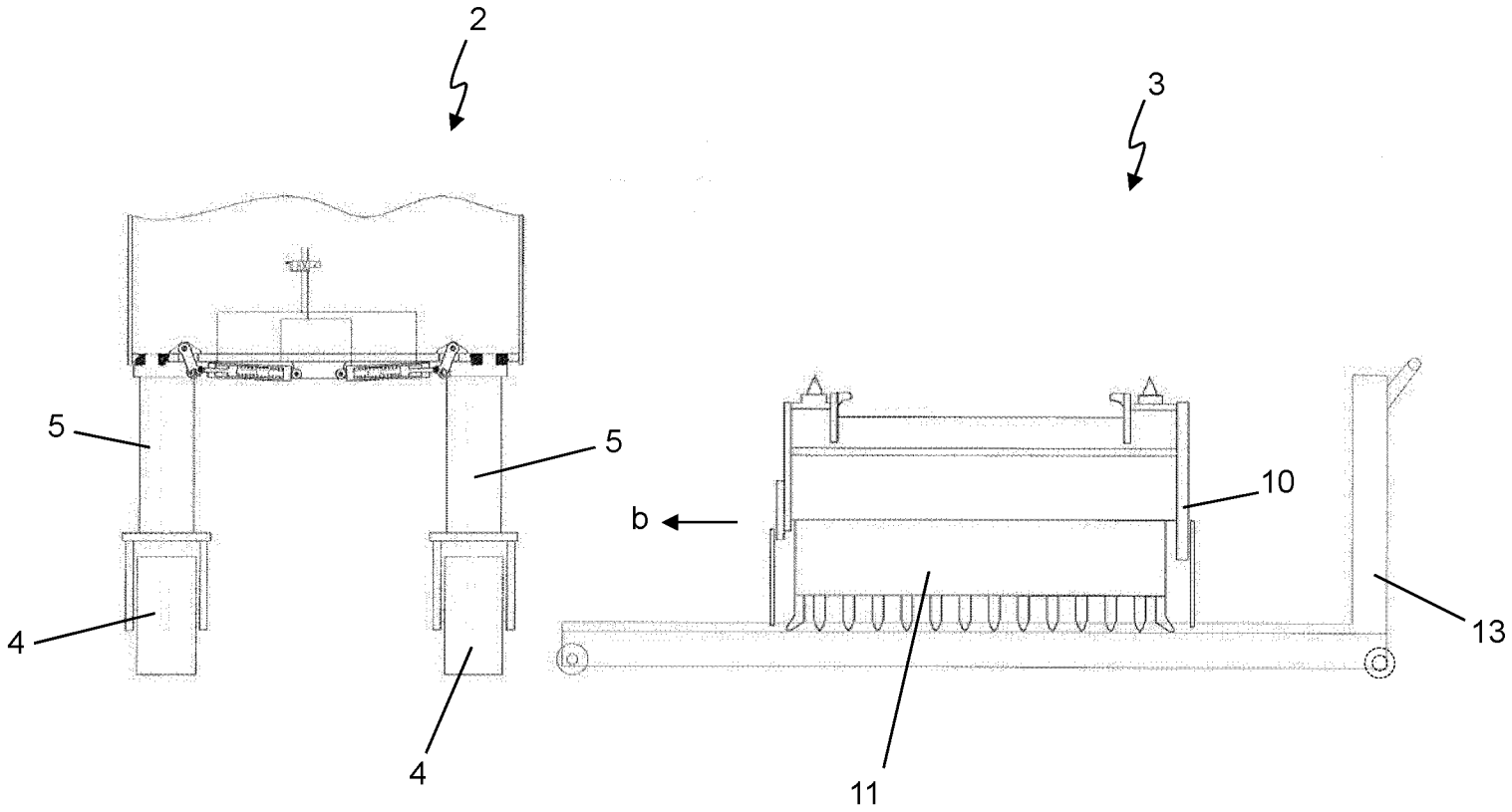
FIG. 2 shows a partial cross-sectional view through the ground milling machine having separate milling part.

FIG. 2 shows the state before the installation of the removed milling part 3 with disassembled milled material conveyor device before the installation of the milling part 3 on the machine part 2 in the viewing direction of the arrows towards section line I-I from FIG. 1. The milling part 3 is pushed for this purpose in the present exemplary embodiment via a suitable transportation device (for example, a cart) 13 in the direction b, from a position located laterally adjacent to the machine part 2, transversely to the working direction a below the machine part 2 between the front and rear transportation devices 4. The machine frame 6 is moved upward in the vertical direction via the lifting columns 5, so that there is sufficient space below the machine frame 6 of the machine part 2. The machine part 2 and the milling part 3 are accordingly pre-positioned in relation to one another very roughly.

Figure 3A:
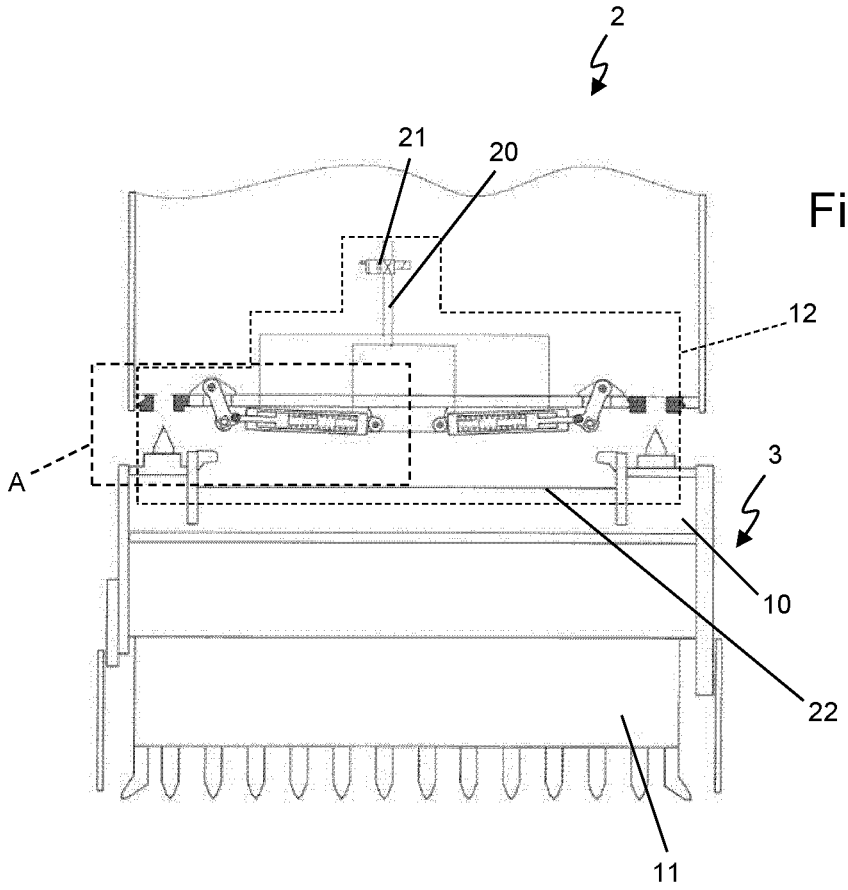
FIG. 3*a* shows the cross-sectional view from FIG. 2 with milling part pre-positioned in relation to the machine part.
Figure 3B:
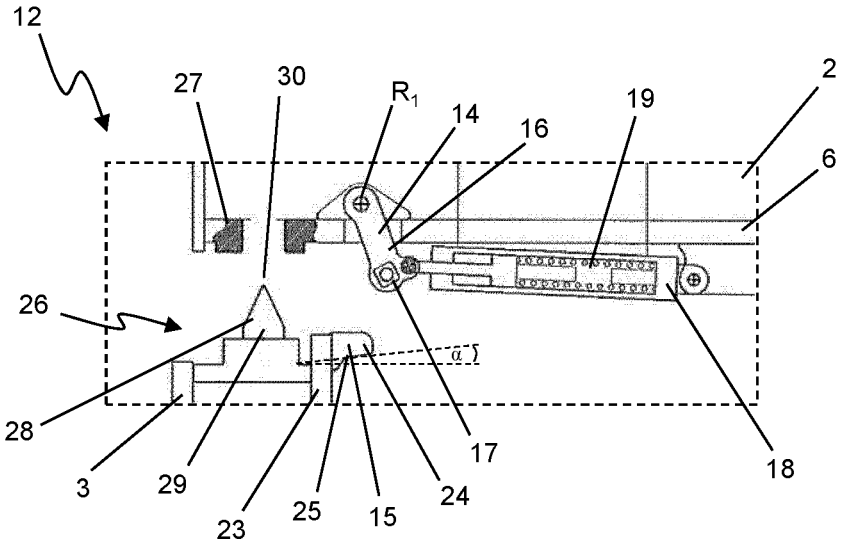
FIG. 3*b* shows a detail enlargement of the region A from FIG. 3*a;*

FIG. 3*a* shows the milling part 3 in this roughly pre-positioned location below the machine part 2, wherein the transport cart 13 and the lifting columns 5 as well as the transportation device 4 were left out for reasons of comprehensibility. FIG. 3*b* further shows the region A from FIG. 3*a* in an enlarged view. The fastening device 12, of which details are first shown, in particular, in FIG. 3*b*, is used for the attachment of the milling part 3 on the machine part 2. The fastening device 12 is mounted in a stationary and movable manner with its individual elements partially on the milling part 3 and partially on the machine part 2 in this case. A complete removal of parts of the fastening device 12 from the milling part 3 and from the machine part 2 is not provided, so that the elements of the fastening device 12 are overall arranged undetachably on the parts 2 and 3.

In the present exemplary embodiment, the fastening device 12 specifically comprises a locking element 14 and a counter element 15. The locking element 14 is implemented as a single-arm pivot lever, which is mounted so it is pivotable on the machine frame 6, and which is movable, in the present case pivotable, about a pivot axis R1, which extends horizontally and in the working direction a, between the release position indicated in FIG. 3*b* and the blocking position, which is indicated, for example, in FIG. 4*b*, which is described in greater detail hereafter. At its end opposite to the bearing end for the axis of rotation R1, a blocking projection 17 is provided on the blocking lever 16, which protrudes out of the plane of the drawing toward the observer from the adjoining surface of the lever element in FIG. 3*b*. Provision may also be made for the blocking projection to be arranged between two similarly implemented blocking levers 16 in the form of a bearing fork.

Figure 4A:
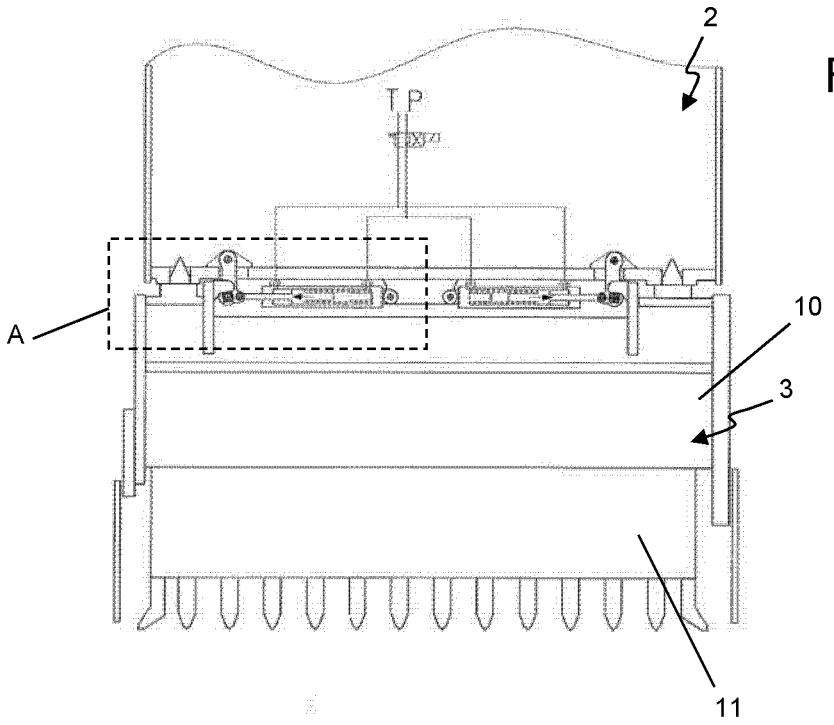
FIG. 4*a* shows the cross-sectional view from FIG. 2 with fastening device located in the blocking position.
Figure 4B:
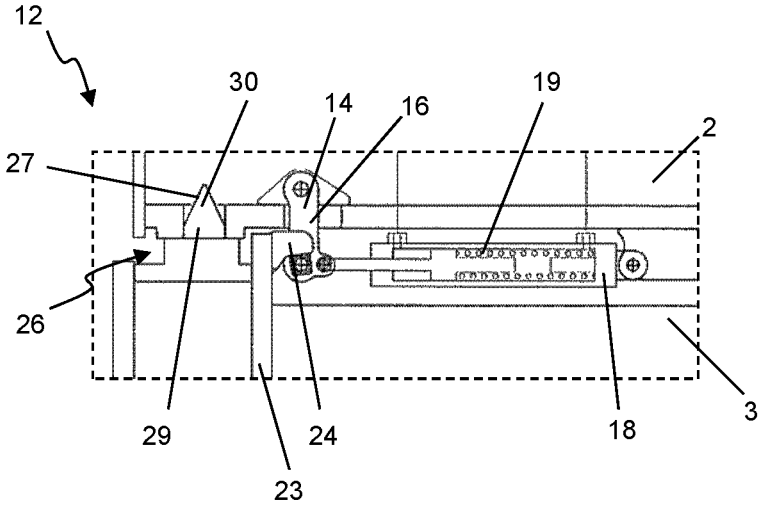
FIG. 4*b* shows a detail enlargement of the region A from FIG. 4*a;*

The displacement of the blocking lever 16, or the locking element 14, respectively, from the release position indicated in FIG. 3*b* into the blocking position shown in FIG. 4*b* is performed automatically, driven by a compression spring 19 arranged inside a drive element 18. The compression spring 19 therefore presses the blocking lever toward the blocking position, in other words it acts in the direction of the blocking position. To displace the locking element 14 into the release position according to FIG. 3*b*, in contrast, a hydraulic pressure is applied to the drive element 18, which is implemented as a hydraulic cylinder-piston unit, via a hydraulic circuit 20 having a corresponding valve 21, as is indicated in FIG. 3*a*. This overall arrangement therefore ensures that in the case of a lack of pressure application, the blocking lever 16 automatically assumes the blocking position according to FIG. 4*b*, driven by the compression spring 19. The hydraulic cylinder is articulated on the cylinder side on the machine frame 2 and on the piston side on the blocking lever 16, respectively. The drive device is therefore arranged in this exemplary embodiment completely on the side of the machine part 2 of the ground milling machine 1.

The fastening device 12 furthermore comprises the counter element 15, which is implemented as a stationary holding hook, which protrudes from an upper wall 22 of the milling drum box, having a web 23 protruding in the vertical direction and a blocking projection 24 protruding perpendicularly in the head region of the web 23. In this case, the blocking projection 17 of the blocking lever 16 engages behind the blocking projection 24, viewed from the machine part 2, to fasten the milling part 3 on the machine part 2, as indicated, in particular, in FIG. 4*b*. The stop surface 24' on the blocking projection 24 for the blocking projection 17 of the blocking lever 16 extends in this case inclined at the angle $\alpha$ in relation to the horizontal plane and slopes downward in the vertical direction in the pivot direction of the blocking lever 16 in the direction of the blocking position. The milling part 3 is thus pressed upward against the machine part 2 in the vertical direction, so that the special implementation of the stop surface 25 with inclination in cooperation with the blocking projection 17 overall acts as a clamping device 51 between the milling part 3 and the machine part 2.

FIGS. 3*a* and 4*a* furthermore illustrate that the fastening device 12 as a whole comprises two locking elements 14 and counter elements 15 each having a drive element 18 according to the above statements. The engagement or stop positions between the respective locking element 14 and the respective counter element 15 are arranged spaced apart as far as possible from one another in this case transversely to the working direction toward the outer sides of the ground milling machine 1. In this embodiment, the two drive elements 18 are connected in parallel to one another via the hydraulic circuit 20 and are both activated acting in the same direction and simultaneously via the valve 21. A pressure application in the position shown in FIG. 3*a* therefore causes pivoting, which is oriented toward one another, of the two blocking levers 16. The operation of the fastening device is performed in this case via a suitable switch, which is not shown in the figures, for example, in the operator platform 8 and/or laterally on the ground milling machine 1 close to the milling part 3.

Separately, and in a separate position from the fastening device 12, a centering and form-fitting device 26 is furthermore provided. It comprises, on the side of the machine part 2, a hollow-cylindrical receptacle opening 27 or pin receptacle and, on the side of the milling part 3, a mandrel 28 or pin, which protrudes upwardly in the direction of the machine part 2, i.e., in the vertical direction, having a cylindrical base part 29 and a centering cone 30, which is seated on the base part and tapers upwardly. If, for the fastening of the milling part 3 on the machine part 2, the milling part 3 and the machine part 2 are moved toward one another from the position shown in FIG. 3*b* toward the position shown in FIG. 4*b*, the centering cone 30 firstly arrives with its tip in the region of the receptacle opening 27. In the case of imprecise relative alignment of the milling part 3 in relation to the machine part 2, the centering cone 30 can slide with its outer surface on the edge of the receptacle opening 27 and therefore trigger exact positioning of the milling part 3 in relation to the machine part 2. In the region of the centering cone 30, the mandrel 28 therefore has play in the receptacle opening 27, which becomes less with increasing displacement movement of the machine part 2 in the direction of the milling part 3. If the cylindrical base part 29 now also slides into the receptacle opening 27 during continued insertion movement, a form fit, which acts transversely in relation to the insertion direction extending in the vertical direction, is obtained between the outer lateral surface of the base part 29 and the inner lateral surface of the receptacle opening 27, so that a form fit is established in the horizontal plane. In the direction of the horizontal plane, the milling part 3 is positioned virtually without play in relation to the machine part 2 by this form fit. This effect is of particular significance insofar as the form fit established by the centering and form-fitting device 26 in the direction of the horizontal plane causes a relief of the fastening device 12 in that it does not have to ensure position fixation between milling part 3 and machine part 2 in the direction of the horizontal plane. Therefore, the fastening device 12 exclusively has to apply clamping forces in the vertical direction to secure the milling part 3 on the machine part 2. Due to this functional separation between vertical securing and horizontal securing, the fastening forces to be applied by the fastening device 12 are comparatively small, so that as a whole it does not have to be implemented as particularly solid and tightening forces to be achieved can also be comparatively small. FIGS. 3*a* and 4*a* illustrate that the centering and form-fitting device 26 is also provided multiple times between the milling part 3 and the machine part 2, specifically two times in the figures. Furthermore, it is essential that the centering and form-fitting device 26 is spaced apart further outward in the horizontal plane in relation to the longitudinal central axis in the working direction a than the fastening device 12. Optimum securing in the direction of the horizontal plane is obtained by the arrangement of the centering and form-fitting device 26 spaced apart as far as possible from the outer sides and therefore as far as possible from one another.

Figure 5:
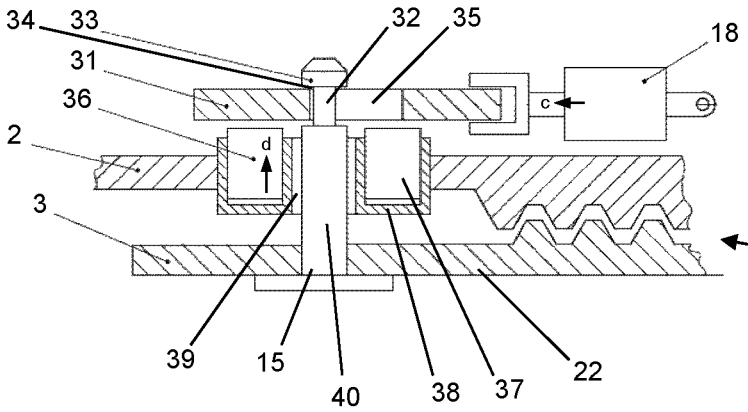
FIG. 5 shows a partial cross-sectional view of the fastening device of a second alternative embodiment.
Figure 6:
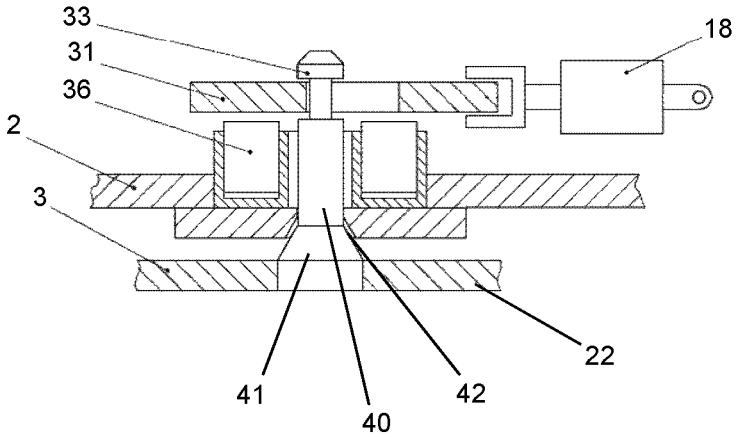
FIG. 6 shows a partial cross-sectional view of a third alternative embodiment of a fastening device.
Figure 7:
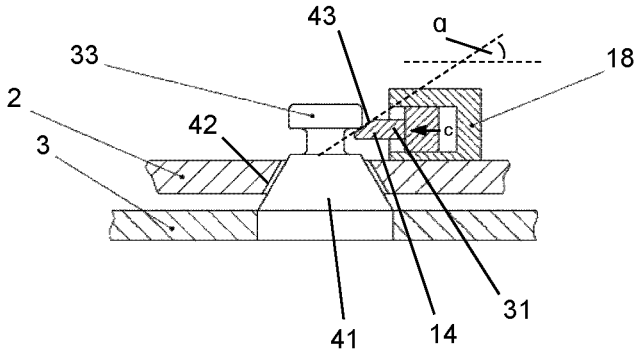
FIG. 7 shows a partial cross-sectional view of a fourth alternative embodiment of a fastening device.

FIGS. 5, 6, and 7 now illustrate alternative embodiments, in particular, of the fastening device 12, the centering and form-fitting device 26, and the clamping device 51, wherein in each case a detail corresponding to FIG. 4*b* is indicated.

The locking element 14 in the exemplary embodiment according to FIG. 5 is implemented as a locking slide 31, which is movable by the drive element 18 in the horizontal direction in the arrow direction c from the blocking position shown in FIG. 5 into a release position. The plate-like locking slide 31 is linked for this purpose via a bearing fork, which is not shown in greater detail, to the piston of the cylinder-piston unit. The counter element 15 is implemented in the present case as a rod element protruding upwardly from the milling part 3 in the vertical direction, the head region of which comprises a taper and a widening adjoining the taper 32 towards the top in the vertical direction, the thickness of the counter element in the horizontal plane being smaller in the region of the taper 32 than in the region of the widening 33. The taper can therefore be considered overall to be a blocking constriction in the rod-shaped counter element 15. A stop surface 34, which is transverse to the insertion direction extending in the vertical direction, on the widening 33 toward the taper 32 is thus obtained, against which the locking slide 31 stops and is clamped in the manner described hereafter.

In the blocking position shown in FIG. 5, the locking slide 31 is positioned such that it overlaps the stop surface 34 in the removal direction of the milling part 3 and, therefore, prevents a withdrawal of the widening 33 through the receptacle opening 35 in the locking slide 31 in the release direction. If the locking slide 31 is now moved into the release position in the arrow direction c, it releases the counter element 15 when the stop surface 34 is pushed in the vertical direction out of the region of the widening 33 and the widening 33 is therefore located with its stop surface 34 completely inside the receptacle opening 35 in the locking slide 31, viewed in the vertical direction.

The locking slide 31 is furthermore not arranged on the outer side of the machine part 2, but rather on an inner side facing away from the milling part 3 and is covered, except for the passage opening 39 discussed in greater detail hereafter, by the machine part 2. The locking slide 31 is thus protected toward the external environment.

The clamping of the milling part 3 in relation to the machine part 2 is performed by a hollow cylinder 36. The hollow cylinder is mounted on the cylinder side on the machine frame of the machine part 2. The hollow cylinder comprises a piston 37 extending in a circular ring and a cylinder 38, which accommodates this piston and is also in the form of a circular ring. A passage opening 39 extends through the middle of the hollow cylinder 36 in the vertical direction, through which the counter element 15 is guided coming from the milling part 3. The passage opening 39 is arranged aligned with the receptacle opening 35 in the locking slide 31 in this case, at least when the locking slide 31 is in the release position. If the locking position indicated in FIG. 5 is established between the locking element 14 (locking slide 31) and the counter element 15, the hollow cylinder 36 is used for the subsequent clamping of the milling part 3 in relation to the machine part 2. For this purpose, the hollow cylinder 36 extends the piston 37 upwardly in the vertical direction (arrow direction d) and strikes in this case against the lower side of the locking slide 31. During continued displacement movement, the piston 37 therefore presses the locking slide 31 against the stop surface 34 in the region of the widening 33 of the counter element 15. Clamping of the milling part 3 in relation to the machine part 2 in the vertical direction is thus ensured as a whole. The clamping device, which is not identified in greater detail in FIG. 4, therefore comprises the hollow cylinder 36, the counter element 15, and the locking slide 31.

In the exemplary embodiment according to FIG. 5, a centering and form-fitting device 26 having the effects described in the preceding exemplary embodiment is also provided. Specifically, the centering and form-fitting device 26 is implemented as ribbing, which is implemented complementary to one another, in the outer sides facing toward one another in the milling part 3 and in the machine part 2. The ribbing comprises in this case protrusions and depressions having trapezoidal profile, wherein corrugated structures or structures implemented in another manner are also conceivable at this position, which each enable a complementary engagement of the milling part 3 on the machine part 2 with elements overlapping in the horizontal direction. Furthermore, centering of the milling part 3 in relation to the machine part 2 is enabled by the structures, which taper in the direction away from the machine part 2 or from the milling part 3.

With respect to the implementation of the fastening device, the exemplary embodiment according to FIG. 6 is based on the exemplary embodiment according to FIG. 5, so that reference is made in this regard to the corresponding statements on FIG. 5. The essential difference of the exemplary embodiment according to FIG. 6 is firstly in the implementation of the centering and form-fitting device 26, which is an integral component of the counter element 15 in the present exemplary embodiment. The shaft 40 of the counter element 15 protruding upward in the vertical direction from the milling part 3 has a conical widening toward the upper wall 22 of the milling drum box. For the form-fitting accommodation of this conical region, a conical receptacle opening 42, which widens downward in a funnel-like manner, is provided below the hollow cylinder 36 on the machine part 2, this receptacle opening ensuring an exact alignment and a form-fitting securing in the horizontal direction of the milling part 3 in relation to the machine part 2. In this exemplary embodiment, the centering and form-fitting device 26 and the fastening device 12 are therefore functionally and spatially implemented as a coacting aggregate.

FIG. 7 now relates to an alternative approach, in particular, with respect to the clamping of the milling part 3 on the machine part 2. The centering and form-fitting device 26 is based on the exemplary embodiment according to FIG. 6, so that reference is made to the statements in this regard. The essential difference is the implementation of the locking slide 31 in comparison to FIG. 6. It is also driven by a drive element 18, which is implemented as a hydraulic cylinder, in the horizontal direction c. In its tip region, however, the piston 37 of the hydraulic cylinder comprises a sliding bevel 43 on the locking element 14, which extends toward the tip at an angle $\alpha$ in relation to the horizontal plane, as indicated in FIG. 7 by the dashed lines. With the region of the sliding bevel 43, the locking slide 31 of the locking element 14 engages behind the widening 33 and therefore protrudes into the region of the taper 32. The widening 33 therefore runs on the sliding bevel 43, so that the milling part 3 is pressed upwardly during continued pushing out movement of the locking slide 31 in the vertical direction and is therefore drawn in the region of the centering and form-fitting device 26 into the conical receptacle in the machine part 2. In this embodiment, the clamping device, comprising the sliding bevel, the locking slide 31, and the widening 33, and the fastening device 12 are therefore implemented as a structurally and functionally coacting aggregate.

Figure 8:
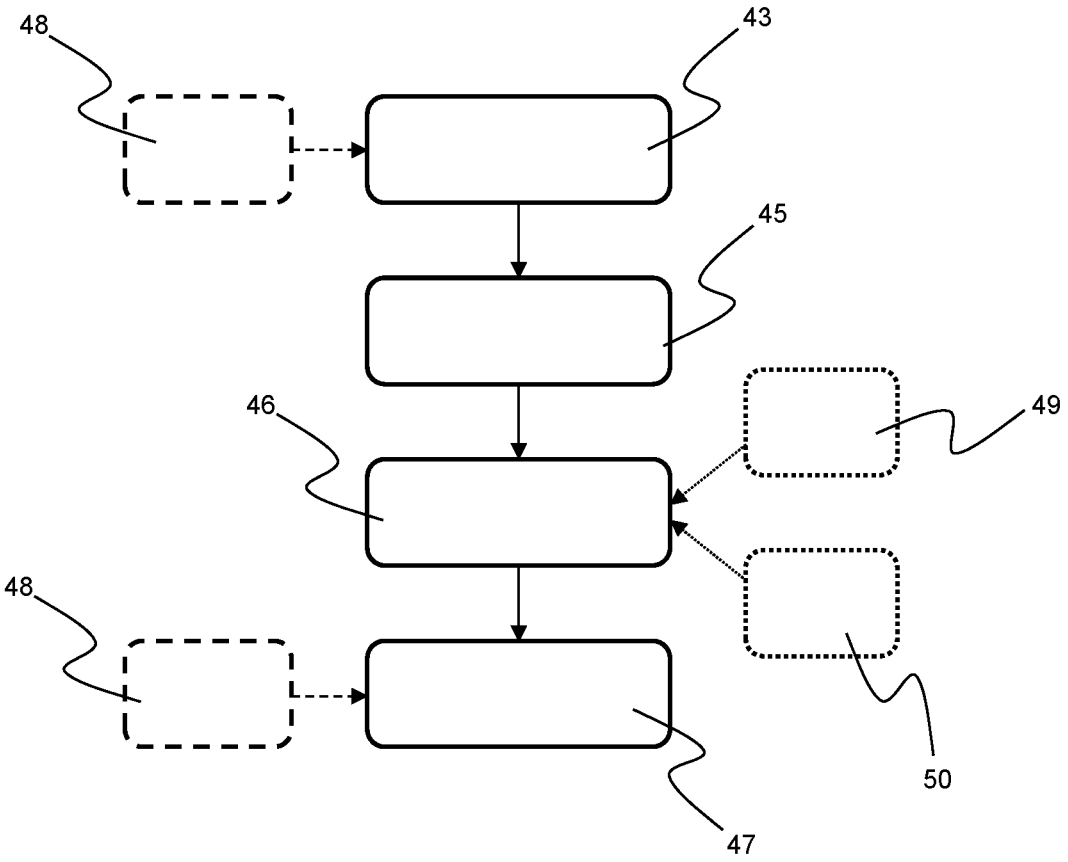
FIG. 8 shows a flow chart to illustrate the sequence of the method according to the present invention.

FIG. 8 now illustrates the steps of the method according to one embodiment of the present invention for the removal and mounting of a milling part 3 from or on the machine part 2. The procedure is initiated in step 44 by a displacement of a locking element, in particular, according to one of the preceding exemplary embodiments, of a fastening device, via which the milling part is held on a machine part of the ground milling machine, from a blocking position into a release position. Therefore, the blocking of the counter element achieved by the fastening device is canceled by the locking element. In step 45, the removal of the milling part from the machine part is performed. The machine part is now substantially lighter in relation to the overall ground milling machine and therefore is more likely to meet existing maximal transport weights. For the mounting of the milling part, for example, upon reaching the construction site, firstly the milling part is moved toward the machine part. To fasten the milling part, in step 46, the positioning of the milling part on the ground milling machine is then performed such that the counter element and the locking element of the fastening device are aligned in relation to one another such that the locking element is again displaceable into the blocking position to block the counter element. In step 46, the relative position of the locking element and the counter element of the fastening device is therefore reestablished such that a blocking engagement of the locking element on the counter element is possible. For the final fastening, it is therefore provided in step 47 that the displacement of the locking element from the release position into the blocking position is performed to fasten the milling part on the machine part of the ground milling machine. Blocking of the counter element on the ground milling machine is thus performed, so that in the end result, the milling part cannot be removed from the machine part of the ground milling machine without canceling the blocking. This procedure can of course also be used for replacing a first milling part with a second milling part.

For easier execution of this method, provision is made for the displacement of the locking element to be driven by a drive device, in particular, a hydraulic, mechanical, electromechanical, or pneumatic drive device. To displace the locking element, the operator must therefore only operate a drive device and does not have to carry out the displacement procedure of the locking element himself and apply the forces required for the displacement himself. In this case, it may be provided that, for the displacement movement of the locking element into the blocking position and into the release position, driving by the drive device according to step 48 is provided in each case, as indicated in FIG. 8. Alternatively thereto, however, provision may also be made for this purpose for an automatic displacement of the locking element into the respective position to be performed for steps 44 and/or 47, for example, by compression spring loading.

Additionally, or alternatively, to improve the positioning of the milling part on the ground milling machine according to step 46, provision may be made for the alignment of the milling part in relation to the machine part to be performed via a centering device, which enables centering, i.e., exact alignment of the milling part in relation to the machine part (according to step 49). Furthermore, the establishment of a form fit acting in the horizontal direction between the milling part and the ground milling machine may also be provided according to step 50 to obtain positioning security in the horizontal plane.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A ground milling machine, comprising a machine part having a machine frame, an operator platform, a drive engine, and transportation devices driven by the drive engine;

a milling part having a milling drum for milling ground material and a milling drum box for covering the milling drum to the sides and to the top; and a fastening device configured to detachably fasten the milling drum box on the ground milling machine, wherein the fastening device comprises at least one movable locking element and at least one counter element, wherein the fastening device is partially arranged on the machine part and partially arranged on the milling drum box, wherein the locking element is mounted so as to be movable between a blocking position and a release position, the locking element in the blocking position blocking the counter element in a release direction to fasten the milling drum box on the ground milling machine, wherein the fastening device comprises a drive device, which drives a displacement of the locking element between the blocking position and the release position, in particular at least toward the release position, and wherein a formfitting device is provided for positioning the milling drum box on the machine part in a horizontal direction.

2. The ground milling machine according to claim 1, wherein the drive device drives the locking element hydraulically, pneumatically, electromechanically, or electrically.

3. The ground milling machine according to claim 1, wherein the drive device is mounted on the machine part and is supplied from the ground milling machine with drive energy to displace the locking element at least from the blocking position into the release position.

4. The ground milling machine according to claim 1, wherein the locking element is implemented as acting automatically toward the blocking position with spring loading.

5. The ground milling machine according to claim 1, wherein a sensor unit is provided which is implemented to detect the blocking position and/or the release position of the locking element.

6. The ground milling machine according to claim 1, wherein the fastening device comprises a blocking lever which is pivotable about a horizontal axis and has a blocking projection which at least partially engages behind the counter element in the blocking position.

7. The ground milling machine according to claim 1, wherein the fastening device has a locking slide which is displaceable in the horizontal direction, and that the counter element comprises a locking slide receptacle, in which the locking slide at least partially engages in the blocking position.

8. The ground milling machine according to claim 1, wherein the fastening device comprises a clamping device, which is implemented in such a manner that, when the locking element is located in the blocking position, the locking element clamps the milling drum box via the counter element in the vertical direction toward the ground milling machine.

9. The ground milling machine according to claim 8, wherein the clamping device comprises a sliding bevel extending diagonally in relation to a horizontal plane, which acts against the counter element when the locking element is located in the blocking position.

10. The ground milling machine according to claim 9, wherein a sliding surface of the sliding bevel extends at an angle of less than 30° in relation to the horizontal plane.

11. The ground milling machine according to claim 8, wherein the clamping device comprises a clamping cylinder which is arranged in such a manner that, in the pressure-loaded state, the clamping cylinder presses the milling drum box against the machine part.

12. The ground milling machine according to claim 11, wherein the clamping cylinder is a hollow cylinder with a central recess, said central recess being provided for threading in the counter element.

13. The ground milling machine according to claim 11, wherein the clamping cylinder presses in the vertical direction from below against a locking slide.

14. The ground milling machine according to claim 11, wherein a monitoring device is provided which monitors the clamping path of the clamping cylinder.

15. The ground milling machine according to claim 1, wherein the formfitting device comprises a pin protruding in the vertical direction on the milling drum box, and a pin receptacle on the machine part, wherein the pin is insertable in a formfitting manner into the pin receptacle.

16. The ground milling machine according to claim 1, wherein the formfitting device is implemented separately from the fastening device and functionally independent thereof.

17. The ground milling machine according to claim 1, wherein the formfitting device is part of the fastening device.

18. The ground milling machine according to claim 1, wherein a centering device is provided which is implemented to align the machine part in relation to the milling drum box to ensure reliable positioning of the locking element in relation to the counter element.

19. The ground milling machine according to claim 18, wherein the centering device comprises at least one conical projection protruding in the vertical direction and one conical receptacle.

20. The ground milling machine according to claim 18, wherein the centering device on the machine part and on the milling drum box in each case has tooth structures implemented as complementary to one another which are implemented for formfitting interlocking.

21. A method for removing and mounting a milling part of a ground milling machine from or on a machine part of a ground milling machine according to claim 1, comprising the steps of:

a) displacing the locking element of the fastening device, via which the milling part is held on the machine part of the ground milling machine, from a blocking position into a release position;

b) removing the milling part from the machine part;

c) positioning the milling part on the ground milling machine in such a manner that the counter element and the locking element of the fastening device are aligned in relation to one another such that the locking element is displaceable back into the blocking position to block the counter element; and d) displacing the locking element from the release position into the blocking position to fasten the milling part on the machine part of the ground milling machine, the displacement of the locking element being driven by a drive device comprising one of a hydraulic, mechanical, electromechanical, or pneumatic drive device.

* * * * *